US010942017B2

(12) United States Patent
Un et al.

(10) Patent No.: US 10,942,017 B2
(45) Date of Patent: Mar. 9, 2021

(54) INFLATABLE BLASTHOLE PLUG ASSEMBLY

(71) Applicant: Four Flags Pty Ltd, Westminster (AU)

(72) Inventors: John Jang-Yih Un, Westminster (AU); Muhammad Nuer Rahman, Westminster (AU); Brian Joseph Kellett, Westminster (AU); Christopher Royce Loveland, Westminster (AU)

(73) Assignee: Four Flags Pty Ltd, Westminster (AU)

( * ) Notice: Subject to any disclaimer, the term of this patent is extended or adjusted under 35 U.S.C. 154(b) by 0 days.

(21) Appl. No.: 16/470,764

(22) PCT Filed: Nov. 27, 2017

(86) PCT No.: PCT/AU2017/051304
§ 371 (c)(1),
(2) Date: Jun. 18, 2019

(87) PCT Pub. No.: WO2018/112508
PCT Pub. Date: Jun. 28, 2018

(65) Prior Publication Data

US 2019/0331471 A1 Oct. 31, 2019

(30) Foreign Application Priority Data

Dec. 20, 2016 (AU) ..... 2016905269

(51) Int. Cl.
*F42D 1/18* (2006.01)
*F42D 1/22* (2006.01)

(52) U.S. Cl.
CPC ..... *F42D 1/18* (2013.01); *F42D 1/22* (2013.01)

(58) Field of Classification Search
CPC ..... F42D 1/18; F42D 1/22; F42D 1/20; F42D 1/24
See application file for complete search history.

(56) References Cited

U.S. PATENT DOCUMENTS 351,273 A * 10/1886 Learnard ..... F42D 1/18 102/333
465,410 A * 12/1891 Knox ..... F42D 1/18 102/333
2,047,774 A * 7/1936 Greene ..... E21B 33/136 102/333
3,039,534 A * 6/1962 Koop ..... E21B 33/068 166/123

FOREIGN PATENT DOCUMENTS

WO WO-2003/046471 A2 6/2003
WO WO-2006045144 A1 * 5/2006 ..... E21C 37/16
WO WO-2009109008 A1 * 9/2009 ..... F42D 1/18

OTHER PUBLICATIONS

International Search Report; dated Dec. 12, 2017; Authorized Officer Tom Choi; 4 pages.

*Primary Examiner* — Joshua T Semick
(74) *Attorney, Agent, or Firm* — Winstead PC

(57) ABSTRACT

Provided is an extensible spacer (14) for an inflatable blasthole plug (10) in the form of a collapsed bag (12). The spacer (14) includes a body (14.1) attached to the bag (12), and an associated leg formation (16) which may include leg segments (16.1, 16.2).

18 Claims, 9 Drawing Sheets

(56) References Cited

U.S. PATENT DOCUMENTS

| | | | | |
|---|---|---|---|---|
| 4,464,994 | A | 8/1984 | Porter | |
| 7,387,071 | B2 * | 6/2008 | Heinke | E21C 37/16 102/313 |
| 2010/0300318 | A1 * | 12/2010 | Dhooge | F42D 1/18 102/333 |

* cited by examiner

INFLATABLE BLASTHOLE PLUG ASSEMBLY

TECHNICAL FIELD

This invention relates to the field of blasting by means of explosives. More particularly, the invention relates to an inflatable blasthole plug assembly, a method of blasting, a method of deploying an inflatable blasthole plug, and to a spacer for an inflatable blasthole plug.

BACKGROUND ART

The following discussion of the background art is intended to facilitate an understanding of the present invention only. The discussion is not an acknowledgement or admission that any of the material referred to is or was part of the common general knowledge as at the priority date of the application.

When blasting, particularly bench blasting in a mining environment, proper loading of a blasthole is important to ensure material is loosened and/or ejected according to requirements. For this reason, an inflatable blasthole plug is often used to ensure a bulk of explosives placed in a blasthole is at the desired depth and/or position.

Such a blasthole plug generally comprises some manner of inflatable bag, which is typically required to be lowered into a blasthole using a tether and held at a suitable depth while the inflatable blasthole plug, usually in the form of a bag with an internal gas canister containing a propellant, is inflated. Explosive may be loaded in the blasthole prior to the plug being inserted, or the plug may be inserted and then loaded with explosive, following which each blasthole is tamped.

Sometimes over-drilling occurs and blastholes have to be back-filled. In many cases, much time is taken in ensuring that the plug is held at the correct level inside the blasthole by the external tether while the operator awaits the expansion of the inflatable blasthole plug inside the blasthole, wasting time which could be used attending to further blastholes.

The following invention seeks to propose improvements, at least in part, to the existing solutions found in the art.

SUMMARY OF THE INVENTION

Broadly, according to one aspect of the invention, there is provided a spacer for an inflatable blasthole plug, the spacer comprising a body including at least one plug-engaging surface and at least one leg formation having one or more leg segments.

The leg formation may be extensible, i.e. the leg segments may be telescoping, foldable, collapsible, or articulated, the extensibility thereof being commensurate with the distance that the plug is to be spaced from a surface, typically the bottom of a blasthole, i.e. the leg formation is adjustably extensible as per requirements.

The plug-engaging surface may be configured to be attachable to a blasthole plug.

The spacer may thus include a first end for engaging the plug and a second end from which the leg formation may extend or depend.

The spacer may thus be used to pre-select a desired leg length by extending or unfolding the leg segments to a length that broadly correlates to a desired depth at which the plug is to be deployed within the blasthole. Alternatively, a desired leg length may be selected from a plurality of leg formations each of varying length for selection according to requirements.

Advantageously, the leg formation and thus the leg segments may, in a first retracted (i.e. non-deployed) position, be closely associated with, and commensurate with, the body of the spacer, being similar in length to, or slightly longer or shorter than the body and thus also similar in length to, or slightly longer or shorter than a longitudinal axis of the plug to which it is to be attached.

As such, when in the retracted position, the body and leg formation combined may displace an area no larger than at least one side of the plug body.

The body and/or leg formation, when in the retracted position, may each be slightly shorter than at least one side of the plug body.

In another embodiment, the body of the spacer is commensurate with the length of the body of the plug.

The spacer may be deployed so as to align broadly with a longitudinal axis of the blasthole when attached to a plug and dropped into a blasthole.

The leg formation and accompanying segments may be attached to the body by way of an attachment formation such as a pivot, a joint, lines of weakness, an elbow, a friction-fit receptacle, a socket arrangement, or other means that allow the leg formation and/or segments to be individually extended relative to the body. The attachment formation may be selected to lock each segment in place when extended from the body of the spacer, i.e. to prevent collapsing of the leg formation when extended.

In other embodiments, the leg formation may be in the form of telescoping leg segments which may be extended as far as required and then locked in place using locking formations, such as cam locks, twist locks, cone locks, pin locks, spring-loaded (pop-up) pins, or by friction fit or slight interference fit, or the like.

In yet further embodiments, the leg segments may be kept in place by way of a friction fit to keep the leg formation extended when the spacer (and thus associated plug) is to be deployed and to prevent it collapsing under the weight of the plug or combined plug and spacer assembly, prior to full inflation of the plug.

As such, the spacer may be made of a high-density plastic, acrylic, synthetic, or metallic material, preferably a lightweight material such as polypropylene, or ABS plastic (Acrylonitrile Butadiene Styrene), wood, bamboo, or the like.

The spacer may, at or towards a first, free end thereof, have a ground-engaging foot formation attached. The foot formation may serve to not only ensure that the inflatable blasthole plug does not catch on the sides of the blasthole when dropped down the blasthole but also to provide sufficient surface area to prevent the inflatable blasthole plug assembly from sinking into either wet or loose earth at the bottom of the hole, or into viscous explosives which may have been placed in the blasthole prior to the inflatable blasthole plug being dropped into the blasthole.

As such, the foot formation may serve to evenly disperse a weight pressure of the plug assembly when deployed on a surface, increase the buoyancy of the combined plug and spacer assembly, or the like.

To this end, the ground-engaging foot may be curved operatively upwardly towards the plug, splayed, or shaped and dimensioned and have a surface area sufficient to prevent the inflatable blasthole plug assembly from sinking measurably into wet soil or commonly used liquid, gel-like or bulk industrial explosives such as ANFO.

The foot may thus be shaped to provide sufficient buoyancy or flotation to the combined plug and spacer assembly, while not being overly large nor prone to catching on the sides of the blasthole on the way down, nor too heavy so as to exacerbate sinking of the combined plug and spacer assembly.

As such, the foot may be cup-shaped, bowl-shaped, frusto-conical, semi-circular or the like, to prevent it from catching on the interior walls of the blasthole but still providing sufficient footprint to prevent the plug and spacer from sinking into, or becoming mired in, the ground (or in cases where explosives are loaded first, into the explosives).

In one example, the first end of the spacer may include a top cap configured to cover and seal the spacer against the ingress of fluid and/or particulate material, e.g. dirt and grit.

According to a further aspect of the invention, there is provided an inflatable blasthole plug assembly for use in a blasthole, the inflatable blasthole plug assembly including:

an inflatable blasthole plug; and a spacer attached to the inflatable blasthole plug for achieving vertical spacing of the inflatable blasthole plug from an end of the blasthole, substantially as described herein.

The inflatable blasthole plug may include a propellant that can be activated selectively to ensure that the bag does not over-inflate prior to reaching a desired depth when dropped down the blasthole, but is sufficient to inflate the plug to a cross-section sufficient to plug the blasthole to a desired degree. This ensures that the propellant can be activated, the inflatable blasthole plug assembly can be dropped into the blasthole, be stationed at a desired depth due to the spacer length having been selected to correspond to a desired depth in the blasthole, and inflate of its own accord to lodge firmly within the blasthole, once activated. In this way, the time taken to populate a field of blastholes with the inflatable blasthole plug assembly of the invention is minimized, as an operator is not required to await full inflation of each inflatable blasthole plug prior to moving to the next blasthole.

The inflatable blasthole plug may be any suitable type of inflatable or distensible bladder used in blasting, typically bladders made of a synthetic plastics material.

The propellant may be in the form of a canister of propellant, the canister including an activation trigger to ensure that full expansion of the inflatable blasthole plug is achieved. As such, the volume of propellant is generally commensurate with the volume of the inflatable blasthole plug to ensure a snug, friction fit within the blasthole when distended. In another example, the propellant may comprise a chemical bag having separate chemicals that, when forced to interact, produce a suitable propellant for inflating the blasthole plug, e.g. sodium bicarbonate and vinegar, or the like.

The trigger may have a stepped mechanism for allowing slow or fast inflation of the inflatable blasthole plug, depending on the required rate of propellant release and thus rate of inflation of the inflatable blasthole plug.

The spacer may be manufactured integrally with the inflatable blasthole plug, i.e. as a unitary structure, or it may be attached via attachment formations to the inflatable blasthole plug. In one embodiment, the spacer is moulded or glued to the bag. In another embodiment, the inflatable blasthole plug may be provided with a channel, sleeve or pocket for receiving at least one end of the spacer.

According to a still further aspect of the invention, there is provided a method of deploying an inflatable blasthole plug, the method including:

determining a desired distance which a plug is to be spaced from a bottom or mouth of a blasthole;

providing a plug assembly of the invention, including a spacer, a leg formation, and a foot formation, the plug having a canister internal thereto for inflating the plug;

extending one or more leg segments of a spacer substantially as described herein to be roughly commensurate with the desired depth to which the plug is to be deployed relative to the bottom of the blasthole;

activating the canister contained within the plug to commence inflation of the bag; and dropping the plug assembly of the invention down the blasthole, with the foot formation first.

According to yet another aspect of the invention, there is provided a method of blasting, the method including:

in a field of blastholes to be loaded, deploying one or more of the inflatable blasthole plug assemblies of the invention in one or more blastholes to be loaded.

BRIEF DESCRIPTION OF THE DRAWINGS

The description will be made with reference to the accompanying drawings in which.

DESCRIPTION OF EMBODIMENTS

Figure 1:
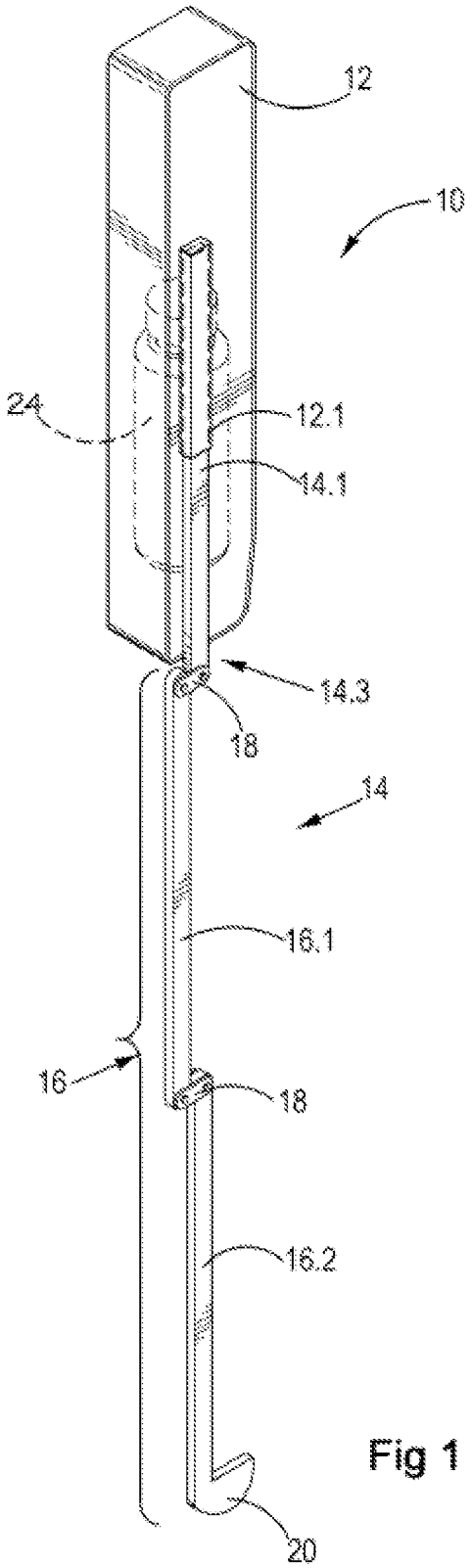
FIG. 1 is a perspective view diagrammatic representation of one embodiment of a spacer and blasthole plug assembly of the invention.

Further features of the present invention are more fully described in the following description of several non-limiting embodiments thereof. This description is included solely for the purposes of exemplifying the present invention to the skilled addressee. It should not be understood as a restriction on the broad summary, disclosure or description of the invention as set out above. In the figures, incorporated to illustrate features of the example embodiment or embodiments, like reference numerals are used to identify like parts throughout.

Throughout this specification, the term "blasthole" may refer to any type of hole drilled in rock, into a boulder, or other material for the placement of explosive.

Throughout this specification, the term "explosive" or "explosives" refers to any type of chemical compound, mixture, or device, the primary or common purpose of which is to function by explosion. Explosive may include not only explosives, but also blasting agents, and detonators. The term includes, but is not limited to, dynamite and high explosives; slurries, emulsions, and water gels; black powder and pellet powder; ANFO; initiating explosives; detonators (blasting caps); safety fuse; squibs; detonating cord; igniter cord; and igniters.

By "explosion" is meant a chemical reaction involving an extremely rapid expansion of gases, usually with the liberation of heat.

Throughout this specification, the terms "loading" or "charging" refer to placing explosives or explosive material in a blasthole or against the material to be blasted.

Throughout this specification, the term "plug" refers generally to an inflatable or distensible bag-type assembly comprising an inflatable or distensible bladder which can be inflated by any inflation means into an inflated or distended position in which it is suitable for plugging or partially plugging a blasthole.

Broadly, the invention provides a spacer for an inflatable blasthole plug (commonly referred to as a "gas bag"). Blasthole plugs are commonly used in blasting operations to ensure sufficient spacing between the bottom of a drilled blasthole and the mouth of the blasthole, so that suitable amounts of explosives can be loaded into the blasthole, depending on operating, geological, or other requirements, or the type of explosive used.

In general, there may be a wide variation in composition and drill depths in an area to be blasted and a common problem is that existing blast hole bags have to be individually lowered into the blasthole by an operator following activation of an inflation container or canister internal to the plug, and then held by the operator using a tether at the desired depth until the bag has expanded to plug the blasthole.

The spacer and plug assembly of the invention intends to greatly increase the speed with which a field of blastholes can be populated, by allowing an operator to simply extend the spacer (attached to the body of the plug) to the desired length, activate the inflation canister or other propellant inside the plug, and drop the plug assembly (i.e. plug and associated spacer) into the blasthole without having to wait for the plug assembly to inflate before moving on to the next blasthole.

The spacer of the invention thus keeps the plug at the desired depth or distance from the bottom of the blasthole while the plug is inflating or distending to engage with the side of the blasthole. This ensures a snug fit or seal within the blasthole, irrespective of whether explosive has been loaded below or above the plug.

Throughout the drawings, reference numeral 10 is generally used to indicate a plug assembly of the invention, which comprises, in the embodiment shown, a plug in the form of a collapsed bag 12 having attached thereto a spacer, shown generally using reference numeral 14. The spacer 14 includes a body 14.1 attached to the bag 12, and an associated leg formation 16. In some embodiments, the leg formation 16 includes leg segments 16.1, 16.2.

Figure 3A:
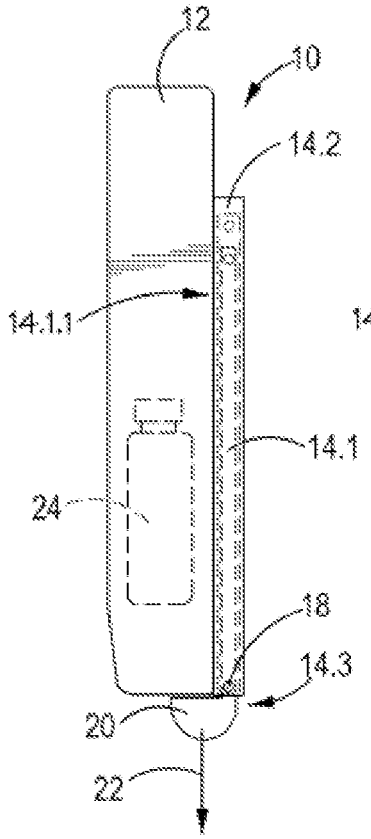
FIGS. 3A, 3B, 3C show side views of another embodiment of a spacer and blasthole plug assembly of the invention.

As may best be seen in FIG. 3A, the body 14.1 of the spacer 14 includes at least one plug-engaging surface 14.1.1 at or towards a first end 14.2 thereof.

Figure 2A:
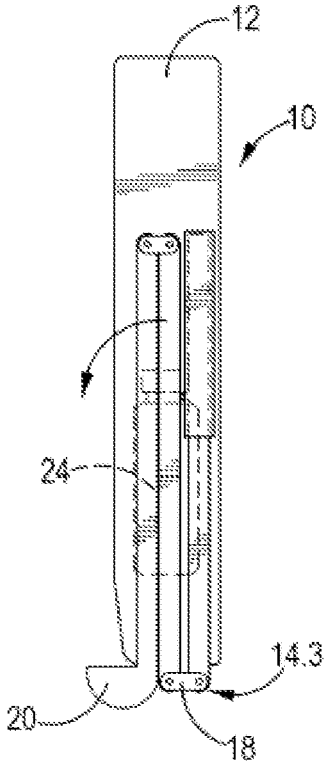
FIGS. 2A, 2B & 2C show side views of one embodiment of a spacer and blasthole plug assembly of the invention.
Figure 2B:
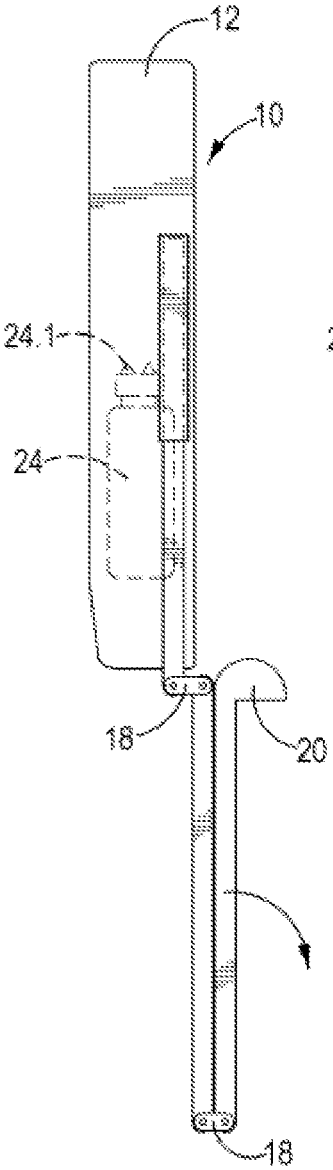
Figure 2C:
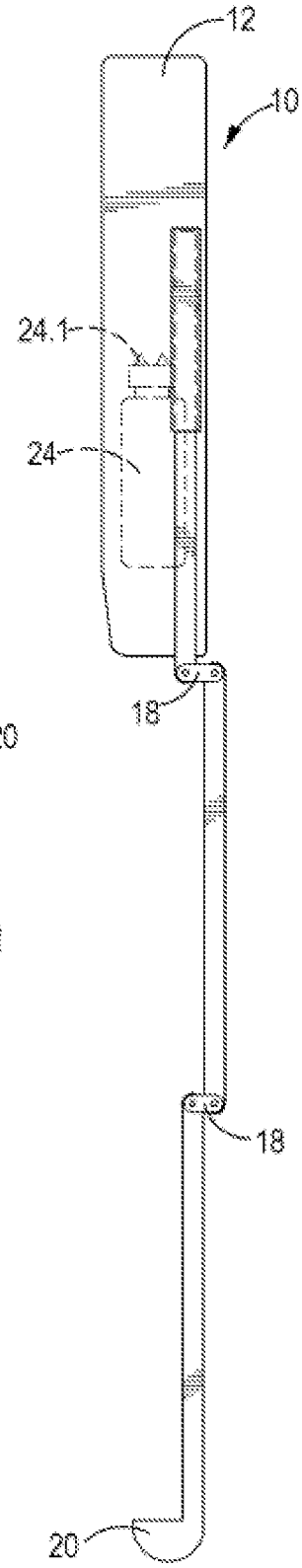
Figure 3B:
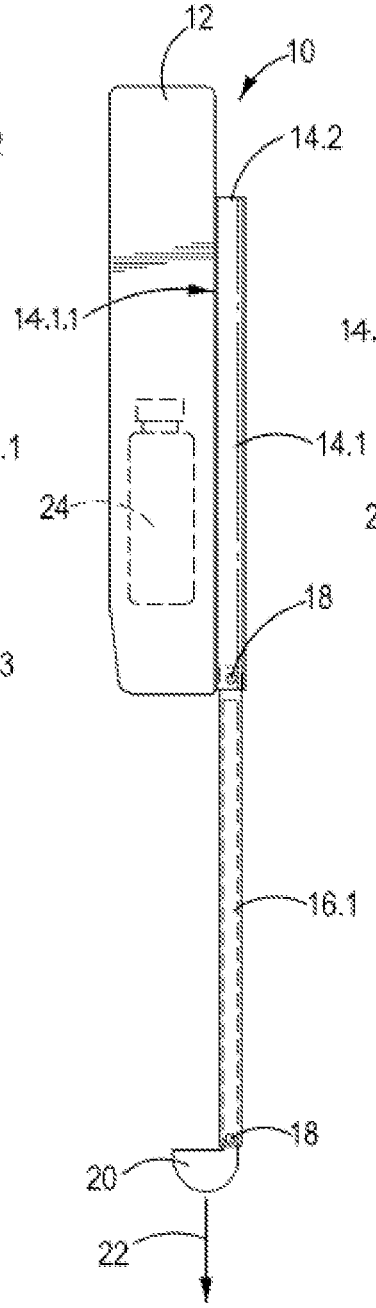
Figure 3C:
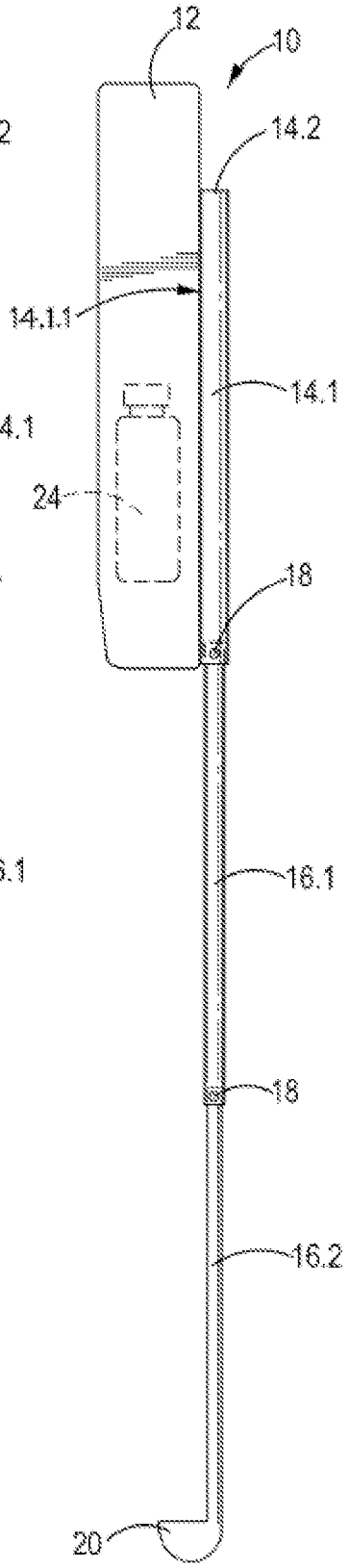

The spacer body 14.1 also includes a second end 14.3 to which the leg formation 16 is attached (as shown in the articulated leg formation embodiment shown in FIGS. 1 to 2C) or from which the leg formation 16 extends or depends (as shown in the telescoping leg formation embodiment shown in FIGS. 3A, 3B, and 3C).

Figure 4:
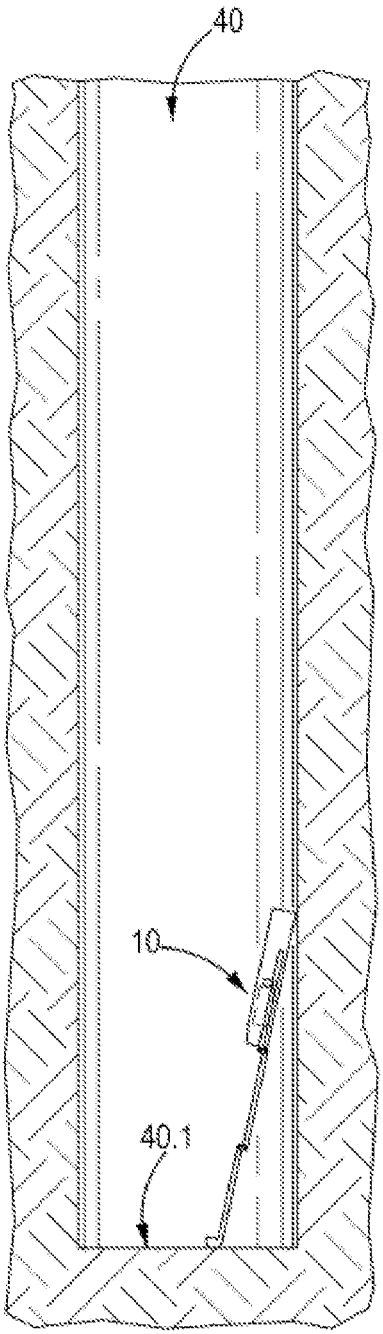
FIG. 4 is a cross-sectional representation of a spacer and blasthole plug assembly of the invention prior to inflation, at the bottom of a blasthole, prior to explosives loading.
Figure 5:
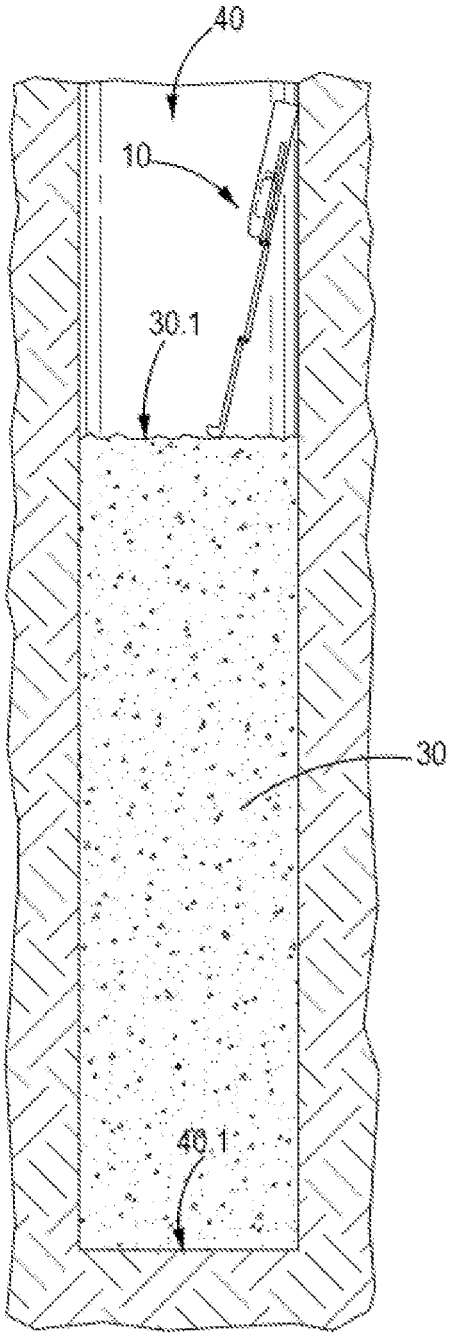
FIG. 5 is a cross-sectional representation of a spacer and blasthole plug assembly of the invention prior to inflation, at the bottom of a blasthole, following explosives loading.
Figure 6:
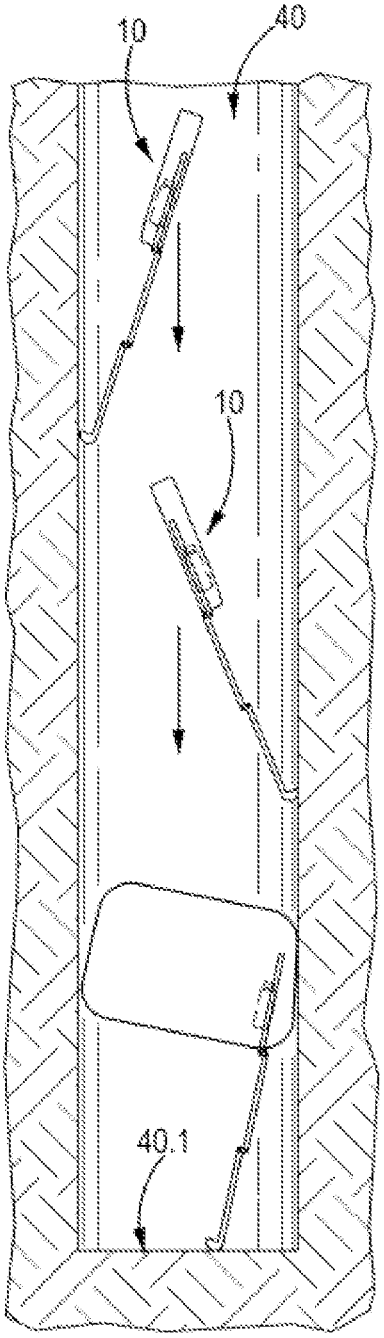
FIG. 6 is a representation of a blasthole plug assembly of the invention travelling down a blasthole, with the assembly at the bottom having been inflated.
Figure 7:
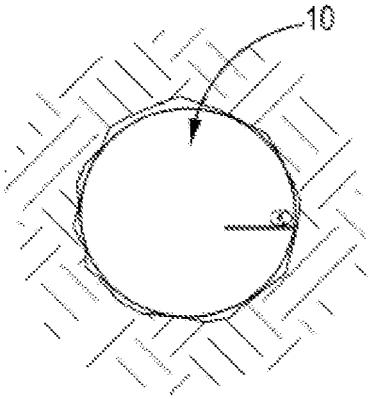
FIG. 7 is a top view of a plug of the invention when fully inflated inside a blasthole.
Figure 8:
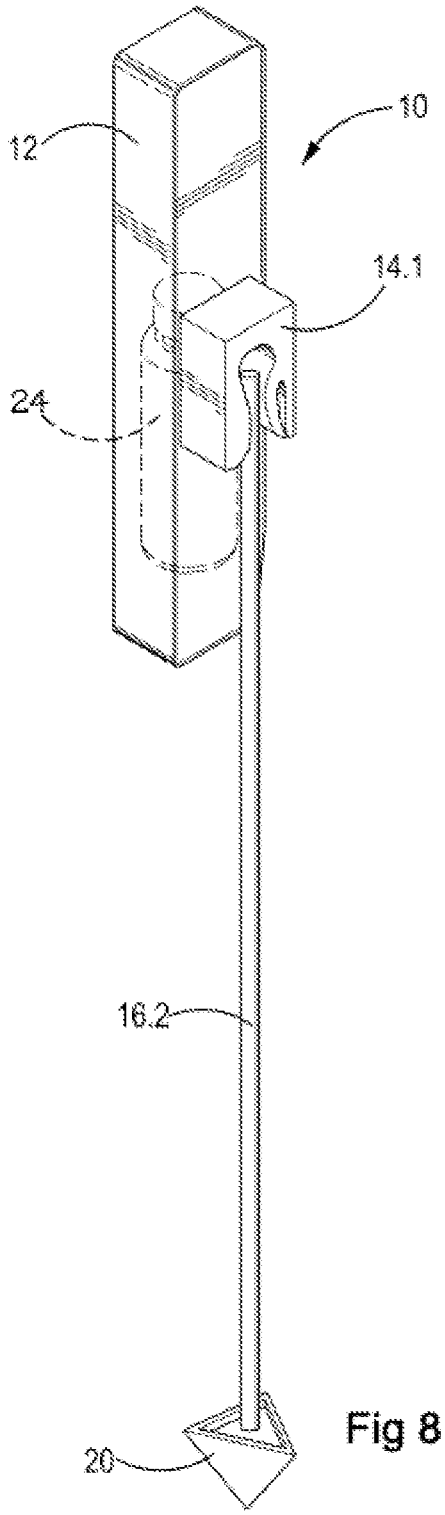
FIG. 8 is a perspective view diagrammatic representation of a further embodiment of a spacer and blasthole plug assembly of the invention.

The spacer 14 serves as a support stand and allows specific placement of the plug assembly 10 within a blasthole (shown generally by reference numeral 40 in FIGS. 4, 5, and 6) relative to the base and sides of the borehole. Current inflatable blasthole plugs (not shown) of which the Applicant is aware that need to be placed at a specific point in the hole are usually positioned relative to the top of the blasthole (known as the hole collar) by means of lowering into the hole on a tether and waiting for the inflating blasthole plug to grip the sides of the hole at which point the tether is removed or discarded).

Figure 9A:
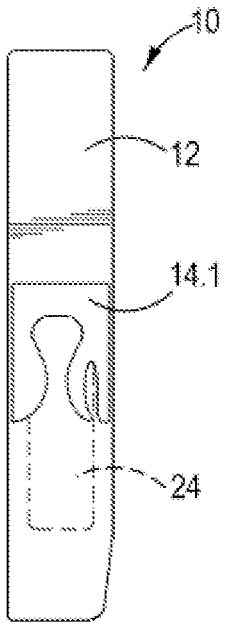
FIGS. 9A, 9B & 9C show rear views of different embodiments of a spacer and blasthole plug assembly of FIG. 8.
Figure 9B:
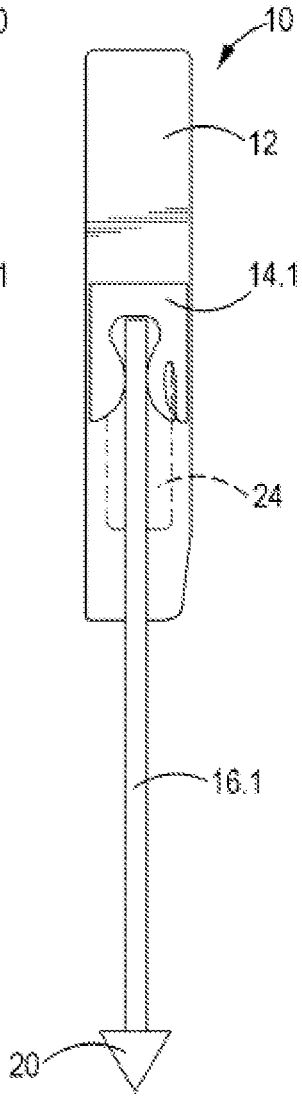
Figure 9C:
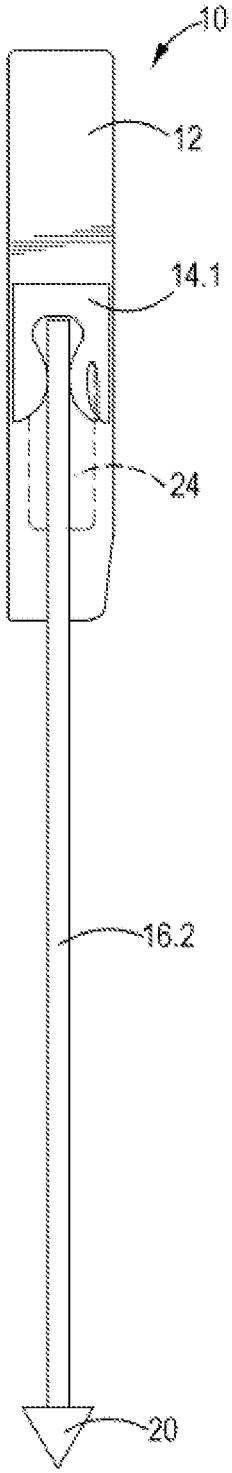
Figure 10:
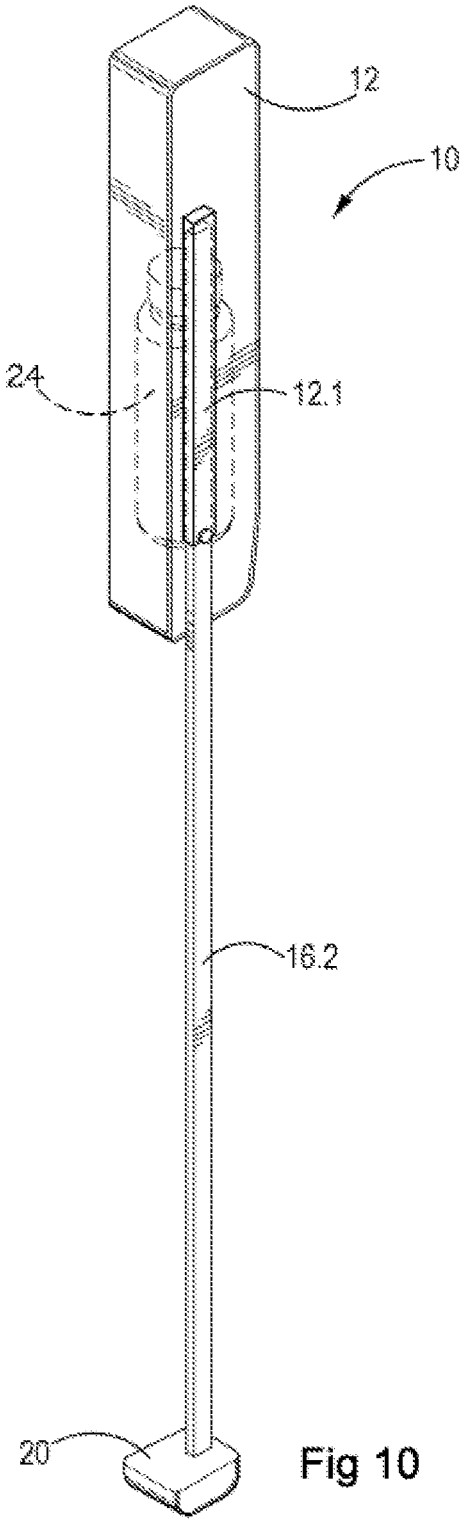
FIG. 10 is a perspective view diagrammatic representation of a yet further embodiment of a spacer and blasthole plug assembly of the invention.
Figure 11A:
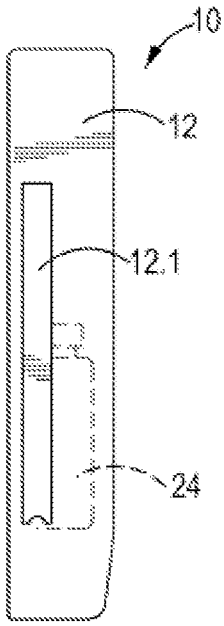
FIGS. 11A, 11B, 11C show rear views of different embodiments of a spacer and blasthole plug assembly of FIG. 10.
Figure 11B:
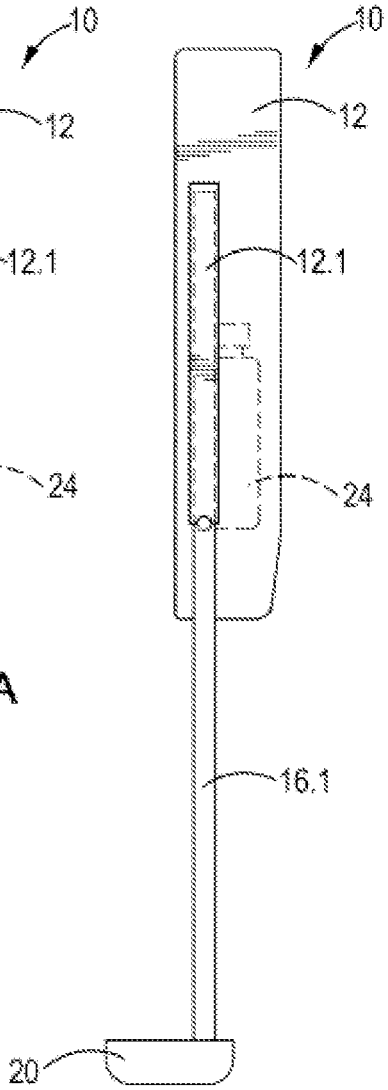
Figure 11C:
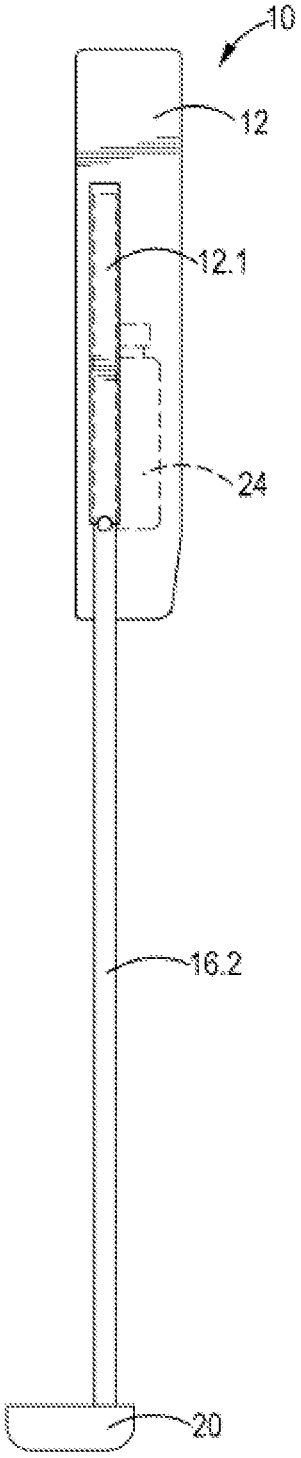

Advantageously, as discussed hereinbefore, the leg formation 16 is extensible, i.e. the leg segments can be telescoping, foldable, collapsible, or articulated, the extensibility thereof being commensurate with the distance that the plug is to be spaced from the bottom of a blasthole, or the upper surface of an explosives charge (shown generally using reference numeral 30 in FIG. 5) when the leg formation 16 is deployed. As shown in FIGS. 1 to 2C, the spacer 14 is used to pre-select a desired depth by extending or unfolding the leg segments 16.1, 16.2 (or more) to a length that broadly correlates to a desired depth at which the plug 12 is to be deployed within the blasthole 40. In another embodiment, shown in FIGS. 9 and 11, the length of the leg formation 16 can also be adjusted by fitting a leg formation 16 having different lengths as per requirements, i.e. there may be a variety of leg formations 16 of different lengths to cater for requirements. Importantly, the extensibility of the leg formation 16 means that a blasthole operator can adjust the length of the leg formation 16 while on site without having to use extraneous tools or methods of lowering the plug.

Usefully, the leg formation 16 and thus the leg segments 16.1, 16.2, in a first retracted or un-deployed position, retract or fold up to a size smaller than or commensurate with the size of the collapsed blasthole plug (bag) 12, as best seen in FIGS. 2A and 3A. As such, the spacer 14 is similar in length to, or slightly longer or shorter than the body and thus also similar in length to, or slightly longer or shorter than a surface of the plug typically a longitudinal axis of the plug, meaning it takes up very little space when compared to the plug 12 in its collapsed or un-inflated form. The spacer is attached to the plug by glue, melding or other attachment means such as hook and loop fasteners. In one embodiment, the plug 12 is provided with a sleeve 12.1 into which the first end 14.1.1 of the spacer body 14 fits snugly in a friction fit manner, best seen in FIG. 1. It is to be understood that the invention is not meant to be limited to any particular manner in which the spacer 14 is to be attached to the plug 12.

The leg formation 16 and accompanying segments 16.1, 16.2 are attached to the spacer body 14 by way of attachment formations, shown generally by way of reference numeral 18. These attachment formations 18 can be in the form of pivots, joints, lines of weakness, elbows, or other means that allow the leg segments to be individually extended relative to the body. The attachment formations are selected to lock each segment in place when extended from the body of the spacer body 14, i.e. to prevent collapsing of the leg formation 16 when extended. In the embodiments shown in FIGS. 1 to 2C, the leg segments 16.1, 16.2 are pivotable around brackets 18. The brackets 18 grip each leg formation 16 and the spacer body second end 14.4 tightly enough to prevent the leg segments 16.1 and 16.2 from collapsing once extended by hand. As such, an operator can, on site, determine the desired depth at which the plug 12 is to be deployed and extend the leg segments 16.1, 16.2 as required.

In another embodiment, the leg formation 16 is in the form of telescoping leg segments 16.1, 16.2 which can be extended in the direction of arrow 22 as far as required and then locked in place using spring-loaded pop-up formations or lugs 18 to lock the leg segments 16.1, 16.2 in place.

For example, in a spacer 14 comprising a body 14.1 and two leg segments 16.1, 16.2 (as shown in FIGS. 3A to 3C), if the plug 12 needs to be spaced by a distance from the bottom 40.1 of a blasthole 40 (best seen in FIGS. 4 to 6) roughly commensurate with the length of a single leg segment 16.1, then only a single leg formation 16.1 need be unfolded or extended from the body 14. If, for example, greater clearance is required from the bottom 40.1 of a blasthole 40, two or even three or more three leg segments can be extended from the body 14. The length of each leg segment 16.1, 16.2 is selected to be commensurate with the length of the body 14, which in turn is commensurate with the length of, or less than, a longitudinal side 12.1 of the plug 12, such that the combined plug 12 and spacer length 14 when, in an uninflated and un-deployed position, is compact and allows for the combined plug and spacer assembly 10 to not take up much more room than just the plug 12 by itself. This facilitates packing and transport of the plugs 12 and associated spacers 14, while still allowing sufficient length of the spacer 14 to be achieved in a rapid fashion. The spacer body 14 is generally slightly shorter than the longitudinal axis of the plug 12. In this embodiment, the spacer is made of a high-density plastics material, preferably a lightweight material, such as polypropylene, ABS (Acrylonitrile Butadiene Styrene), etc.

The spacer 14 includes at the end of the final leg segment 16.2, a foot or "boot" formation 20. The foot formation 20 assists in ensuring that the inflatable blasthole plug 12 tends not to catch on the sides of the blasthole 40 when dropped down the blasthole 40 but, more importantly, serves to provide sufficient surface area to prevent the inflatable blasthole plug assembly 10 from sinking into either wet or loose earth at the bottom 40.1 of the blasthole 40, or into viscous explosives 30 which may have been placed in the blasthole 40 prior to the inflatable blasthole plug assembly 10 being dropped into the blasthole 40.

In the embodiment shown in FIGS. 1 through 6, the foot formation 20 is cup-shaped and has a surface area sufficient to prevent the inflatable blasthole plug assembly 10 from sinking significantly into wet soil or commonly used liquid or gel-like explosives such as ANFO. The foot formation is thus shaped to provide sufficient flotation while not being overly large nor prone to catching on the sides of the blasthole on the way down. As such, the foot formation 20 is designed to deflect the falling assembly 10 towards a centre of the blasthole 40 and avoid the spacer 14 penetrating the walls of the blasthole 40 and 'catching' before achieving the desired hole plug placement or depth. The foot formation 20 also thus increases the buoyancy of the combined spacer and blasthole plug assembly 10 and is shaped and configured to not permit excessive penetration into the material forming the base of the blasthole. Specifically, the foot formation limits penetration into the bottom of the blasthole when the inflatable plug and spacer are dropped on top of bulk explosive product. A foot formation of insufficient surface area (or a spacer without such a foot formation) would penetrate the unconsolidated explosive.

The inflatable plug 12, when activated, expands at a rate which enables passage of the entire assembly 10 down the blasthole length 40 until the bottom of the foot formation comes in contact with the bottom 40.1 of the blasthole 40 (or top of the column of explosives 30.1). The spacer retains the unit at this level until the expanding plug grips the walls of the hole. At this point the spacer serves no purpose and the plug 12 has sealed the blasthole 40. Fixed size plugs tend to catch on the walls of the blasthole 40 on the way down and are also thus difficult to position with accuracy and expediency.

A further advantage of the spacer 12 and blasthole plug assembly 10 of the invention is that they do not require cuttings to be added after the hole 40 has been plugged using the spacer 12 and assembly 10 of the invention.

Current designs, of which the Applicant is aware, have a high on-site failure rate, cannot be installed in 'hardened collars' and have a fixed length, meaning that they cannot readily be extended on site to a desired length. These fixed units have a tendency to 'bridge the hole' and cannot be unblocked due to their fixed nature. In the unlikely event the spacer or assembly of the invention bridges at an undesired height, the assembly can be popped and retrieved by a hook and the hole is able to be reprimed with a new assembly. This further reduces net hole failure rate.

The inflatable blasthole plug includes a propellant that can be activated selectively to ensure that the bag does not over-inflate prior to reaching a desired depth when dropped down the blasthole, but is sufficient to inflate the plug to a cross-section sufficient to plug the blasthole to a desired degree. This ensures that the propellant can be activated, the inflatable blasthole plug assembly can be dropped into the blasthole, be stationed at a desired depth due to the spacer length having been selected to correspond to a desired depth in the blasthole 40, and inflate of its own accord to lodge firmly within the blasthole 40, once activated. In this way, the time taken to populate a field of blastholes with the inflatable blasthole plug assembly 10 of the invention is minimized, as an operator does not have to await full inflation of each inflatable blasthole plug 12 prior to moving to the next blasthole 40.

The inflatable blasthole plug 12 comprises any suitable type of inflatable bladder used in blasting, typically bladders made of a synthetic plastics material such as PVC, polypropylene, HDPE, nylon and others. As such, the bladder (or bag) may be in the form of a multi-extrusion plastic bag.

The propellant is in the form of a canister 24 of propellant, the canister 24 including an activation trigger 24.1 to ensure that full expansion of the inflatable blasthole plug 12 is achieved. As such, the volume of propellant is generally commensurate with the volume of the inflatable blasthole plug 12 to ensure a snug, friction fit within the blasthole 40 when distended. Typical propellant used may include a mix of or pure refrigerants, hydrocarbons, or chemical reactants. As such, the blasthole plug bladder is selected to conform to, and fit snugly within, a blasthole having a particular cross-sectional diameter.

In one embodiment, the trigger 24.1 is a commercially available propellant canister and includes a stepped mechanism (not shown) for allowing slow or fast inflation of the inflatable blasthole plug 12. The trigger can also be in the form of a notched trigger with two or more set points, depending on the required rate of propellant release and thus rate of inflation of the inflatable blasthole plug. The trigger comprises a complete canister discharge mechanism with single or multiple discharge rates. A slow discharge is desirable in certain applications, but variable options are of benefit as different temperatures result in different discharge rates.

The spacer may be manufactured integrally with the inflatable blasthole plug, i.e. as a unitary structure, or it may be attached via attachment formations to the inflatable blasthole plug. In one embodiment, the spacer is moulded or glued to the bag. The inflatable blasthole plug may be provided with a channel, sleeve or pocket for receiving at least one end of the spacer.

According to a still further aspect of the invention, there is provided a method of deploying an inflatable blasthole plug, the method including:

- determining a desired distance which a plug is to be spaced from a bottom of a blasthole;
- providing a plug assembly of the invention;
- extending one or more leg segments of a spacer substantially as described herein to be roughly commensurate with the desired depth to which the plug is to be deployed relative to the bottom of the blasthole;
- activating the canister contained within the plug to commence inflation of the bag; and
- dropping the plug assembly of the invention down the blasthole, with the foot formation first.

According to yet another aspect of the invention, there is provided a method of blasting, the method including in a field of blastholes to be loaded, deploying one or more of the plugs assemblies of the invention in one or more blastholes to be loaded.

It is an advantage of the inflatable blasthole plug assembly and spacer of the invention that it may be used in both top column air deck applications, as well as in mid-column air deck, bottom column air deck, or pre-splitting air deck applications. As such, more than one plug may be used in a given blasthole to obtain different blasting configurations, as required.

A further advantage is that the method and assembly of the invention obviates the requirements for the addition of stemming or cuttings to be added above the plug assembly. The fact that the plug assembly of the invention allows one to place two plugs in direct contact with one another without having to remove the spacer (i.e. by not extending the leg, in which case it does not extend past the plug itself), is another advantage.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. As used herein, the term "and/or" includes any and all combinations of one or more of the associated listed items. No language in the specification should be construed as indicating any non-claimed subject matter as essential to the practice of the claimed subject matter.

It is to be appreciated that reference to "one example" or "an example" of the invention, or similar exemplary language (e.g., "such as") herein, is not made in an exclusive sense. Various substantially and specifically practical and useful exemplary embodiments of the claimed subject matter are described herein, textually and/or graphically, for carrying out the claimed subject matter.

Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise. Variations (e.g. modifications and/or enhancements) of one or more embodiments described herein might become apparent to those of ordinary skill in the art upon reading this application, and the inventor(s) intends for the claimed subject matter to be practiced other than as specifically described herein.

Any method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. An extensible spacer for an inflatable blasthole plug, the spacer comprising:

- a body including at least one plug-engaging surface;
- at least one leg formation comprising one or more leg segments;
- wherein the extensible spacer is attached to the inflatable blasthole plug for achieving vertical spacing of the inflatable blasthole plug from an end of the blasthole;
- wherein at least one of the one or more leg segments is extendable to be roughly commensurate with a desired depth to which the inflatable blasthole plug is to be deployed relative to the bottom of the blasthole; and
- wherein a bottom leg segment comprises a ground-engaging foot formation attached to the inflatable blasthole plug to prevent the inflatable blasthole plug from catching on the sides of the blasthole when the inflatable blasthole plug is dropped down the blasthole and providing a surface area to prevent a inflatable blasthole plug assembly from sinking into either wet or loose earth at the bottom of the hole, or into viscous explosives which may have been placed in the blasthole prior to the inflatable blasthole plug being dropped into the blasthole.

2. The extensible spacer of claim 1, wherein each leg segment are telescoping, foldable, collapsible, or articulated, the extensibility of said leg formation being commensurate with the distance that the plug is to be spaced from the bottom of a blasthole, and wherein the spacer is useable to pre-select a desired leg length by extending, unfolding, or attaching each leg segment to a length that broadly correlates to a desired depth at which the plug is to be deployed within the blasthole.

3. The extensible spacer of claim 2, wherein each leg formation and each leg segment are, in a first retracted (i.e. non-deployed) position, closely associated with, and commensurate with, the body of the spacer, being similar in length to, or slightly longer or shorter than the body and thus also similar in length to, or slightly longer or shorter than a length along a longitudinal axis of the plug to which it is to be attached.

4. The extensible spacer of claim 3, wherein when in the retracted position, the body and leg formation combined displaces an volume no larger than at least one side of the body, and wherein the body and/or leg formation, when in the retracted position, are slightly shorter than at least one side of the plug body.

5. The extensible spacer of claim 2, wherein each leg formation and accompanying segments are attached to the body by way of attachment formations such as pivots, joints, lines of weakness, elbows, or other means that allow each leg segment to be individually extended relative to the body.

6. The extensible spacer of claim 5, wherein the attachment formations are selected to lock each segment in place when extended from the body of the spacer to prevent collapsing of each leg formation when extended.

7. The extensible spacer of claim 1, wherein the plug-engaging surface is configured to be attachable to a blasthole plug, said spacer including a first end for engaging the plug and a second end from which each leg formation extends or depends.

8. The extensible spacer of claim 1, which is deployable so as to align broadly with a longitudinal axis of the blasthole when attached to a plug and dropped into a blasthole.

9. The extensible spacer of claim 1, wherein the leg formations are in the form of telescoping leg segments which may be extended as far as required and then locked in place using locking formations, such as cam locks, twist locks, cone locks, pin locks, spring-loaded (pop-up) pins, or by friction fit or slight interference fit.

10. The extensible spacer of claim 1, wherein each leg segment is kept in place by way of a friction fit to keep each leg formation extended when the spacer (and thus associated plug) is to be deployed and to prevent it collapsing under the weight of the plug or combined plug and spacer assembly, prior to full inflation of the plug.

11. The extensible spacer of claim 1, which is made of a high-density plastic, acrylic, synthetic, or metallic material, or wood or bamboo.

12. The extensible spacer of claim 1, wherein the ground-engaging foot formation is curved operatively upwardly towards the plug, splayed, or shaped and dimensioned and has a surface area to prevent the inflatable blasthole plug assembly from sinking measurably into wet soil or commonly used liquid, gel-like or bulk industrial explosives such as ANFO.

13. The inflatable blasthole plug assembly of claim 12, which includes a propellant selectively activatable to ensure that the bag does not over-inflate prior to reaching a desired depth when dropped down the blasthole, but is sufficient to inflate the plug to a cross-section sufficient to plug the blasthole to a desired degree.

14. The inflatable blasthole plug assembly of claim 13, wherein the propellant is in the form of a container or canister of propellant, the container or canister including an activation trigger to ensure that full expansion of the inflatable blasthole plug is achieved, a volume of propellant commensurate with the volume of the inflatable blasthole plug to ensure a snug, friction fit within the blasthole when distended.

15. The inflatable blasthole plug assembly of claim 14, wherein the inflatable blasthole plug is inflated based, at least in part, on the required rate of propellant release and corresponding rate of inflation of the inflatable blasthole plug.

16. The inflatable blasthole plug assembly of claim 13, wherein the spacer is manufactured integrally with the inflatable blasthole plug.

17. The extensible spacer of claim 1, wherein the foot formation is cup-shaped, bowl-shaped, frustoconical, semi-circular, or pyramidal to prevent said foot from catching on the interior walls of the blasthole whilst still providing a footprint to prevent the plug and spacer from sinking into, or becoming mired in, the ground or explosives pre-loaded into the blasthole.

18. A method of deploying an inflatable blasthole plug, the method including:

- determining a desired distance which a plug is to be spaced from a bottom or mouth of a blasthole;
- providing a plug assembly, wherein the plug assembly comprises:
  - an inflatable blasthole plug; and
  - an extensible spacer attached to the inflatable blasthole plug for achieving vertical spacing of the inflatable blasthole plug from an end of the blasthole, wherein the extensible spacer comprises a body comprising at least one plug-engaging surface and at least one leg formation having one or more leg segments;
- wherein the plug assembly further comprises a foot formation, and wherein the plug assembly comprises a container or canister internal thereto for inflating the inflatable blasthole plug;
- extending one or more leg segments of the extensible spacer to be roughly commensurate with a desired depth to which the inflatable blasthole plug is to be deployed relative to the bottom of the blasthole;
- activating the container or canister contained within the plug assembly to commence inflation of a bag; and
- dropping the plug assembly down the blasthole with the foot formation first.

* * * * *